US006353792B1

(12) United States Patent
Murthy

(10) Patent No.: US 6,353,792 B1
(45) Date of Patent: Mar. 5, 2002

(54) SYSTEM AND METHOD FOR REMOTE COMMUNICATION OF TRAFFIC MONITORING DEVICE DATA

(76) Inventor: Sudhir Murthy, 209 Lowell St., Lexington, MA (US) 02420

( * ) Notice: Subject to any disclaimer, the term of this patent is extended or adjusted under 35 U.S.C. 154(b) by 0 days.

(21) Appl. No.: 09/610,827

(22) Filed: Jul. 6, 2000

Related U.S. Application Data

(60) Provisional application No. 60/142,648, filed on Jul. 6, 1999.

(51) Int. Cl.[7] ..... G08G 1/123

(52) U.S. Cl. ..... 701/117; 701/200; 455/412; 455/456

(58) Field of Search ..... 701/117, 200; 455/412, 426, 457, 507, 555, 556, 557, 511, 515; 705/21; 707/10; 709/217, 219, 230, 232

(56) References Cited

U.S. PATENT DOCUMENTS

| | | | | | |
|---|---|---|---|---|---|
| 4,591,823 | A | | 5/1986 | Horvat | 340/53 |
| 4,916,621 | A | | 4/1990 | Bean et al. | 364/436 |
| 5,173,691 | A | | 12/1992 | Sumner | 340/905 |
| 5,206,641 | A | * | 4/1993 | Grant et al. | 340/905 |
| 5,289,183 | A | | 2/1994 | Hasset et al. | 340/905 |
| 5,317,311 | A | | 5/1994 | Martell et al. | 340/905 |
| 5,528,234 | A | | 6/1996 | Mani et al. | 340/933 |
| 5,673,259 | A | * | 9/1997 | Quick, Jr. | 370/342 |
| 5,691,982 | A | | 11/1997 | Vuori et al. | 370/336 |
| 5,714,943 | A | * | 2/1998 | Rasor | 340/825.44 |
| 5,818,871 | A | * | 10/1998 | Blakeney, II et al. | 375/220 |
| 5,835,026 | A | | 10/1998 | Wicks et al. | 340/905 |
| 5,870,030 | A | * | 2/1999 | Deluca et al. | 340/825.44 |
| 5,878,038 | A | * | 3/1999 | Willey | 370/335 |
| 5,889,477 | A | | 3/1999 | Fastenrath | 340/905 |
| 5,966,663 | A | * | 10/1999 | Gleason | 455/466 |
| 6,021,433 | A | * | 2/2000 | Payne et al. | 709/219 |
| 6,101,168 | A | * | 8/2000 | Chen et al. | 370/228 |
| 6,138,158 | A | * | 10/2000 | Boyle et al. | 709/225 |
| 6,144,651 | A | * | 11/2000 | Rinchiuso et al. | 370/335 |

* cited by examiner

*Primary Examiner*—Tan Nguyen
(74) *Attorney, Agent, or Firm*—Mills & Onello LLP

(57) ABSTRACT

A traffic monitoring system and method allow for remote monitoring of traffic sites by a plurality of users. A plurality of traffic monitoring devices record data related to traffic events. The data is encoded and communicated to a central server using wireless paging technology. The central server decodes and distributes the communicated data and makes the data available to a plurality of remote users. The remote users access the data, for example via the Internet, in order to remotely evaluate the traffic situation

20 Claims, 4 Drawing Sheets

SYSTEM AND METHOD FOR REMOTE COMMUNICATION OF TRAFFIC MONITORING DEVICE DATA

RELATED APPLICATIONS

This application claims the benefit of U.S. Provisional Application No. 60/142,648, filed Jul. 6, 1999, the contents of which are incorporated herein by reference, in their entirety.

FIELD OF THE INVENTION

The present invention relates to the field of telemetry involving the electronic extraction of information from a plurality of remotely located traffic monitoring stations, transmission of the information using two-way paging technology, and providing access to the information to multiple users via the Internet

BACKGROUND OF INVENTION

State departments of transportation currently deploy remote roadside devices to collect traffic information for monitoring highway performance characteristics. Some roadside devices, such as actuated traffic signal controllers, are deployed to monitor, control and manage either an individual traffic signal, or a group of traffic signals, at intersections. The traffic information collected by these devices may include such data as traffic volumes (number of vehicles passing a particular section of the highway during a certain period), or speed, to name only a few. Information from the traffic monitoring devices is extracted either manually, as disclosed in U.S. Pat. No. 4,916,621 to Bean et al., or remotely downloaded to a central computer using traditional data communication methods. The collected information is useful to a number of groups within the transportation department as well as private traveler-information service providers (TISP). The TISPs utilize this information to inform individuals of the prevailing traffic conditions of a given roadway.

Traditional data communication methods between a roadside traffic monitoring device and a central computer include both wireline and wireless. These methods have been exhaustively disclosed in prior patents (see, for example, U.S. Pat. No. 5,317,311 to Martell et al., U.S. Pat. No. 5,528,234 to Mani et. al., and U.S. Pat. No. 5,889,477 to Fasternath.). Wireline techniques commonly employ a modem with dial-up or leased-line telephone lines, or dedicated underground or overhead cables. Wireless techniques commonly include modems based upon narrowband-radio, cellular, microwave or spread-spectrum frequencies. Each of the above wireline and wireless communication methods has proved to be either difficult to install or cost-ineffective for a region-wide implementation.

U.S. Pat. No. 5,835,026 to Wicks et al. discloses the use of paging technology for wireless transfer of traffic-related information from a central location to remote paging units. Users carrying pager receivers are continually updated on local traffic conditions extracted from a compiled traffic database. No provisions are made for collection of the data at the traffic sites for updating the database.

Some methods of data extraction from roadside monitoring devices involve a user stationed at a central computer to poll each device individually. When numerous devices are involved, as is the case in most state departments of transportation, such configurations prove to be cumbersome and time-consuming.

Further, the traditional methods of data collection from the roadside devices do not provide for convenient data sharing between several users. The conventional methods typically allow only one user at a central computer to poll the roadside monitoring devices and download, or otherwise receive, the traffic data. Special hardware and/or software, in addition to the central computer, are necessary for disseminating the collected traffic data to other users.

SUMMARY OF THE INVENTION

The present invention employs a wireless communication method that employs two-way paging technology in a manner that overcomes the drawbacks of the conventional wireless techniques.

The present invention responds to an immediate need for a reliable, cost-effective, and easy-to-implement wireless communication method in the context of telemetry with remote traffic monitoring devices. A convenient system and method are provided for collecting traffic data in a manner that allows multiple users to access the data over the Internet. The present invention relates to both of the primary data transfer aspects of traffic monitoring: from the traffic monitoring devices to a central computer, and from the central computer to the various users of the information collected.

The present invention utilizes the so-called "reverse channel" of contemporary two-way paging technology, where a plurality of pager modems transmit traffic information from a plurality of remote devices to a central location.

Traffic information is extracted from roadside traffic monitoring devices using a micro-controller based communicating device. The extracted information is transmitted to a server via two-way paging technology, wherein multiple remote paging modems transmit data to a central location. Multiple users access the transmitted information stored at the server over the Internet. Advantages of the invention include:

- Typically, traffic data such as volume, occupancy and speed represent small quantities of data in terms of bytes needed to store the data. Two-way paging is optimally suited for transmission of such small quantities of data.
- With the wireless system of the present invention, installation cost is significantly less than the traditional telephone-based communication system. There is no need for the expensive trenching and installation of conduit as is necessary in a telephone-based system. Paging technology is also more reliable and cost-effective than other wireless communication methods, including cellular, radio and spread-spectrum.
- With wireless technology, a monitoring device can be readily transported between locations. This is particularly useful in the field of event-based traffic management. Such systems are applicable to ongoing construction projects as well as major traffic events (ball games, conventions, etc.).
- In a preferred embodiment, the system and method of the present invention results in a decentralized communication system, where each micro-controller based communicating device periodically queries the roadside monitoring device and automatically transmits periodic traffic information. There is no need for a user at a central computer to constantly poll the various field devices as in the contemporary configurations described above.
- The present invention is intrinsically conducive for data-sharing among various agencies and information service providers. The transmitted data is reported to a central location, and is made accessible to a multitude of users over the Internet.

The present invention results in a more efficient data communication configuration Instead of a central computer having to make repeated calls to each field device, as in conventional architectures, under the proposed system, a user at a remote workstation queries the central location and downloads data from all the various field devices at once.

In a preferred embodiment of the system of the present invention, a micro-controller based communicating device periodically queries, and downloads data from, a roadside monitoring device. The communicating device transmits the data via a bi-directional paging network to a first "master" mailbox at an Internet computer server. The server copies the contents of the master mailbox to second "user" mailboxes, each of which is assigned to an authorized user. The contents of the "user" mailboxes are made available to the users to be accessed over the Internet using specialized software installed on their workstation.

The micro-controller based communicating device preferably comprises an integration of a pager modem and a single-board micro-controller (referred to henceforth as "$\mu$C"). The pager modem preferably comprises a two-way narrow-band Personal Communication Services (PCS) transceiver supporting the ReFLEX™ associate protocol. This communication method is widely used for two-way pagers to send and receive alpha-numeric messages. The communicating device is preferably able to interface with most roadside traffic monitoring devices through a serial port, for example an RS-232 serial port. This serial port or alternatively, a second serial port, further provides a pathway for uploading customized software onto flash memory located on the $\mu$C, thereby allowing the communicating device to interface with virtually any traffic monitoring device. The communicating device is fbrther preferably provided with a timer/relay switch to deactivate the device during standby mode, enabling efficient battery power management.

The Internet server operates to receive the information transmitted by the various communicating devices, and stores the information in a first "master" mailbox. Subsequently, the information is copied into second "user" mailboxes, each of which is assigned to a particular user. The user is provided access to his/her uniquely assigned mailbox through customized software resident on the user's workstation. This software downloads the information contained within a user's mailbox by connecting to the server over the Internet.

In one aspect, the present invention is directed to a method of communicating traffic-related data from a traffic monitoring device to a user. The method comprises collecting traffic-related data at a traffic monitoring device. The collected data is encoded according to wireless paging protocol. The encoded data is communicated via a wireless paging network, and received at a server. The received data is decoded according to the wireless paging protocol.

The collection of traffic-related data at the traffic monitoring device preferably comprises periodic polling the traffic monitoring device for updated traffic-related data. Encoding of the collected data preferably comprises periodically requesting data from the traffic monitoring device; receiving the requested data, encoding the data according to wireless paging protocol; and storing the encoded data The wireless paging network may be periodically polled to determine transmission availability; and when available, the encoded data is communicated over the wireless paging network.

The decoded data is preferably stored in a master mailbox and communicated from the master mailbox to a user mailbox. The received, decoded data may be accessed remotely, for example via the Internet.

In another aspect the present invention is directed to a system for communicating traffic-related data from a traffic monitoring device. The system comprises a traffic monitoring device for collecting traffic-related data. An encoder for encodes the collected data according to a wireless paging protocol. A pager modem communicates the encoded data over a wireless paging network A server receives the communicated encoded data, and decodes the received encoded data according to the wireless paging protocol.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
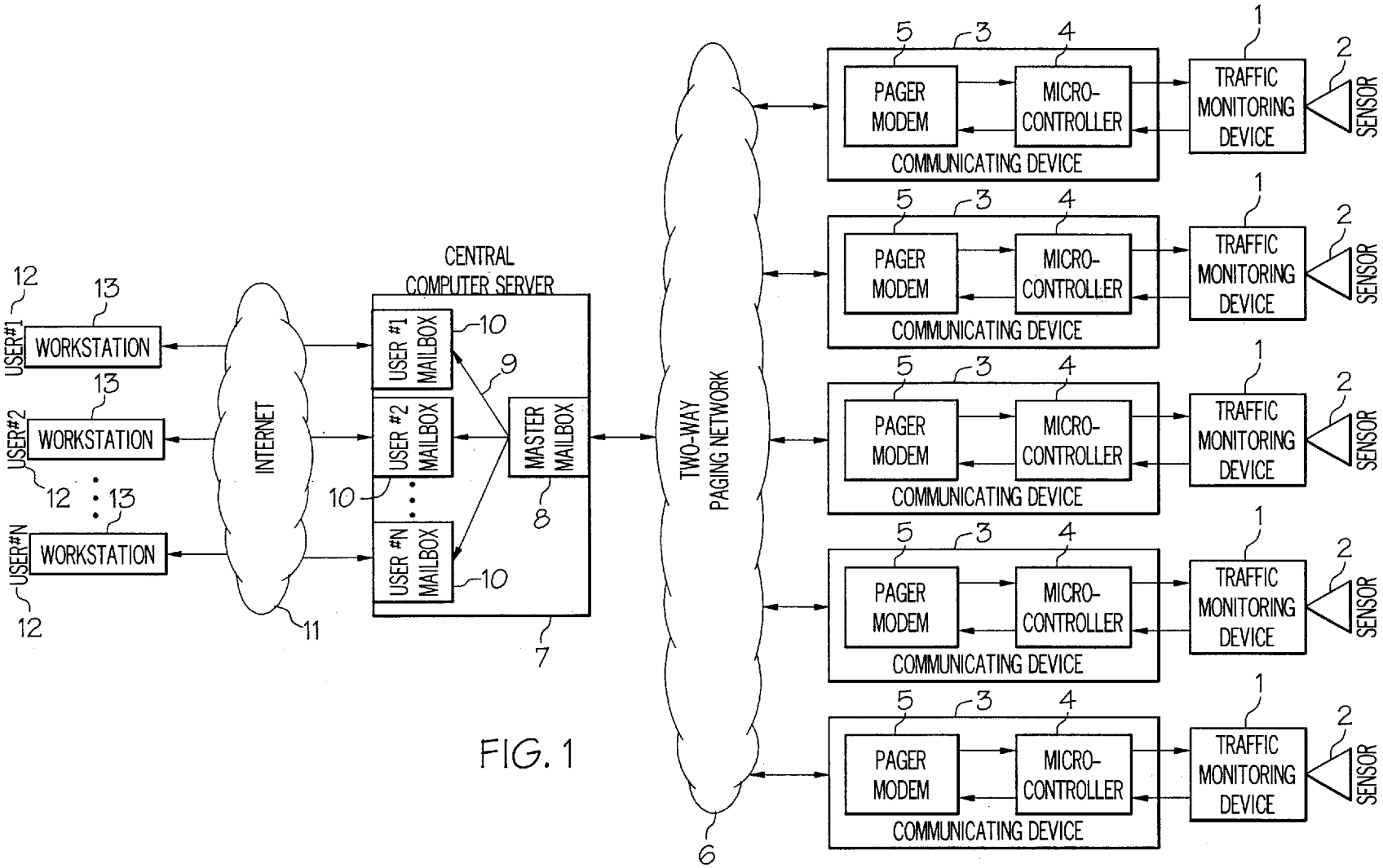
FIG. 1 is a block diagram of a preferred system for traffic data collection and dissemination in accordance with the present invention.

FIG. 1 is a block diagram of a system for remote traffic data collection and dissemination in accordance with the present invention. The various systems involved in the communication of the data from the remote roadside traffic monitoring devices to a central location for access by multiple users over the Internet are provided.

With reference to FIG. 1, a plurality of roadside traffic monitoring devices 1 each include a corresponding sensor 2 or plurality of sensors. The sensor may comprise any of the well-known techniques for sensing traffic, including, for example, inductive loops, microwave radar, laser, sonar, etc. A like plurality of communicating devices ($\mu$C) 3, for example micro-controller based communicating devices, interface with a corresponding traffic monitoring device 1.

Data flow preferably takes place using standard bi-directional, i.e. "two-way", paging technology. A $\mu$C 4 within the communicating device 3 periodically polls the traffic monitoring device 1 to request a download of the data collected by the device 1. Following the download, the $\mu$C 4 processes the data, and formats the data for transmission over the paging network 6. For example, the data may be formatted according to the well-known ReFLEX protocol, containing primarily the address of the destination and the data itself within the $\mu$C 4 memory. Further, to reduce the size of the message, the data may be encoded in a binary format. The address of the destination could be in various forms such as the number of mailbox on the central computer server or an Internet e-mail address or the number to a numeric or alphanumeric pager. In the context of the present invention relating to traffic monitoring, the destination address is preferably the number of a mailbox on the central computer server. Additionally, the other two forms of destination addressing may be used to transmit diagnostics of the remote monitoring device itself such as equipment failures, low battery, and other information that may require some maintenance activity to be performed. The data is then uploaded into a pager modem 5. Upon receiving the data from the $\mu$C 4, the pager modem 5 processes and encodes the data for wireless transmission, and introduces the data into the paging network 6.

A nearby receiver and frame-relay network within the two-way paging network receives the data and transports the data to a central computer server 7 in accordance with standard data transport techniques. At the server 7, the data is decoded and preferably stored in a pre-assigned master mailbox 8. Periodically, the server copies 9 the contents of the master mailbox 8 into user mailboxes 10, for example, each of which may be assigned to a specific user 12. Using software resident on a user's workstation 13, a user can then communicate with the central computer server 7 over the Internet 11 to download the data stored in his/her mailbox 10. The above steps are repeated periodically to provide a continuous flow of data from the traffic monitoring devices 1 to the users 12. The periodic queries by the communicating device 3 of the traffic monitoring device 1 are preferably independent of the periodic downloads by the workstation 13 of each user 12, such that the two queries are temporally independent of each other.

Figure 2:
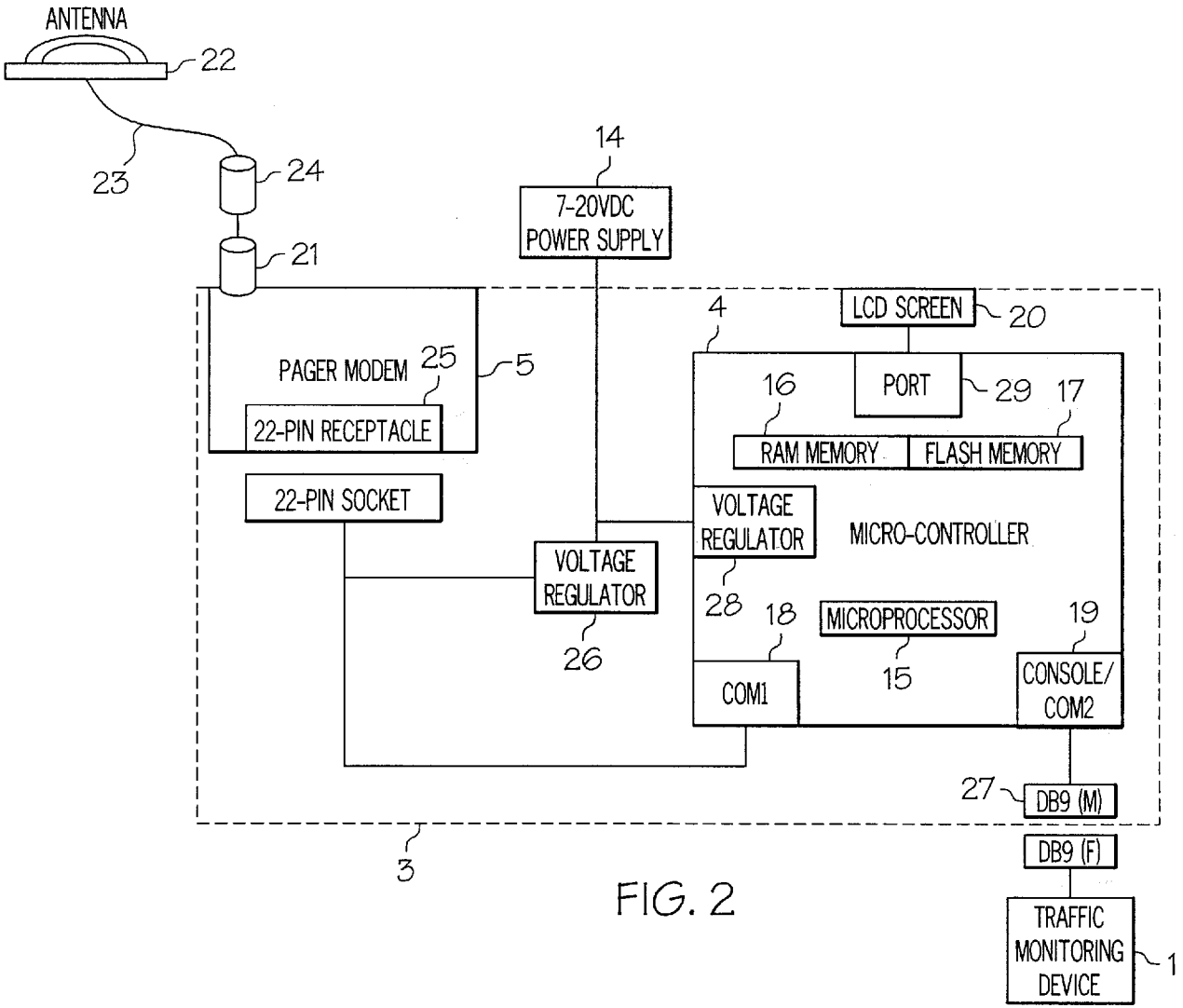
FIG. 2 is a block diagram of the micro-controller based communicating device hardware and interfaces, in accordance with a preferred embodiment of the present invention.

FIG. 2 is a block diagram of the various components of the communicating device 3 including, for example, the micro-controller ($\mu$C) 4, and the pager modem 5. The power supply 14 to the communicating device 3, for example, may be in the range of 7–20 Volts DC. Typically a 12V battery is utilized. Alternatively, power from a 110 VAC supply can be converted via an AC-to-DC voltage adapter to provide a DC voltage consistent with the requirements of the communication device 3. An alternative embodiment may further include, for example, a solid state switch connected to a real-time clock module to turn the power on and off at regular intervals in an effort to conserve battery power.

The $\mu$C 4 operates as the interface between the traffic monitoring device 1 and the pager modem 5. The $\mu$C 4 may comprise, for example, a single-board computer, preferably with a micro-processor 15, with necessary Random Access Memory (RAN 16, and Flash memory 17. The Flash memory 17 is equivalent to the hard disk in a standard personal computer. An on-board back-up battery preferably provides power to the Flash memory 17, allowing the software and other data files to be retained on the $\mu$C 4 even when power to the communicating device 3 is cut off. An example of such a $\mu$C 4 is the Flashlite 386Ex microcontroller (part # 99–0011), manufactured by JK Microsystems of Davis, Calif.

The $\mu$C preferably includes two communication ports, for example serial ports COM1, Console/COM2. The first serial port COM1 18 transports data between the $\mu$C 4 and the pager modem 3. The second serial port Console/COM2 19, as the label indicates, preferably serves a dual purpose. It serves as the console port into the $\mu$C 4 and can be used to upload and/or download software programs, data files, and other software utilities to/from the $\mu$C 4. Upload and/or download of files to/from the $\mu$C 4 is achieved, for example, using any standard communication software supported by the $\mu$C. The second serial port 19 further operates as the COM2 port for transporting data between the communicating device 3 and the roadside traffic monitoring device 1. In an alternative embodiment, the $\mu$C 4 may have a separate communication port exclusively to upload/download software to/from the flash memory 17. Yet another alternative embodiment may utilize EPROM or EEPROM in lieu of Flash Memory 17 on the $\mu$C 4.

The $\mu$C 4 may optionally be provided with a display port 29 for use in connecting a standard Liquid Crystal Display LCD) screen 20. Software operating on the $\mu$C 4 may, for example, use the LCD screen 20 to display the status of operations.

The $\mu$C 4 may include an on-board voltage regulator 28 capable of receiving power in the range of 7–24 Volts DC. The power to the communicating device 3 is directly used to energize the $\mu$C 4, with appropriate fuses for protection.

The pager modem 5 may comprise, for example, a CreataLink2 XT transceiver, available from Motorola The modem 5 operates as a two-way narrowband Personal Communication Services (PCS) modem supporting the ReFLEX protocol for two-way paging. Using a Transistor-Transistor Logic (TTL) or RS-232 serial port, the pager modem can initiate message transmissions into a ReFLEX two-way paging network as well as decode, store, and forward messages received from a ReFLEX two-way paging network to an interconnected host device. The serial port data interface preferably supports the Communication Linking Protocol (CLP). The CLP provides commands to obtain status of the pager modem, to transmit messages and to download received messages.

The pager modem is preferably provided with a female SMA connector 21 that is used to connect an external antenna 22 to the communicating device 3. The external antenna 22 may be of the low-profile type, including a radome, and having a transmit frequency of 896–902 MHz, a receive frequency of 929–941 MHz, and an impedance of 50 ohms. The antenna is provided with a 6-foot long RG58/U coaxial cable 23 terminated at a SMA male connector 24. An example of the external antenna is part PTAF4001A, available from Motorola.

The pager modem 5 preferably operates at a transmit frequency of 901–902 MHz with a data bit rate of 9600 bps, and at a receive frequency of 940–941 MHz with a bit rate of 6400 bps. The interface to the pager modem is preferably via a 22-pin vertical header connector 25 that provides electrical power, and serial and parallel input/output capability.

Power supply to the pager modem 5 is preferably at a constant 5 VDC. The power supply 14 for the communicating device 3 can be further used to power the pager modem 5 via voltage regulator 26 that converts a variable voltage supply in the range of 7–20 V DC to provide an output voltage at a constant 5 Volts DC.

As described above, the interface between the $\mu$C 4 and the pager modem 5 may comprise the COM1 serial port 18 of the $\mu$C 4 and the 22-pin vertical header 25 of the pager modem 5. Table 1 provides an example pin-to-pin connection between the $\mu$C 4 and the pager modem 5.

TABLE 1

| Micro-controller to Pager Modem Interface | |
|---|---|
| COM1 on $\mu$C | 22-pin Vertical Header on Pager Modem |
| 5 ground | 2 |
| 2 receive | 4 |
| 3 transmit | 8 |

The Console/COM2 serial port 19 is preferably connected to a DB9 (male) connector 27 on the communicating device 3 to allow for uploading and downloading of files to and from the $\mu$C 4, or to provide an interface with roadside traffic monitoring devices 1. In alternative embodiments, the $\mu$C 4 may have a separate communication port exclusively to upload/download software to/from the flash memory 17 with the COM2 serial port 19 exclusively to interface with roadside traffic monitoring devices 1.

The design concept embodied in the above-described communicating device 3 may alternatively be achieved in several different ways. One method would be to enhance the electronics internal to the traffic monitoring device, both in terms of hardware and software, to take on the functions of the $\mu$C. While another method would be to utilize a pager modem that also has the additional electronics, both hardware and software, to provide the functions of the $\mu$C.

Figure 3:
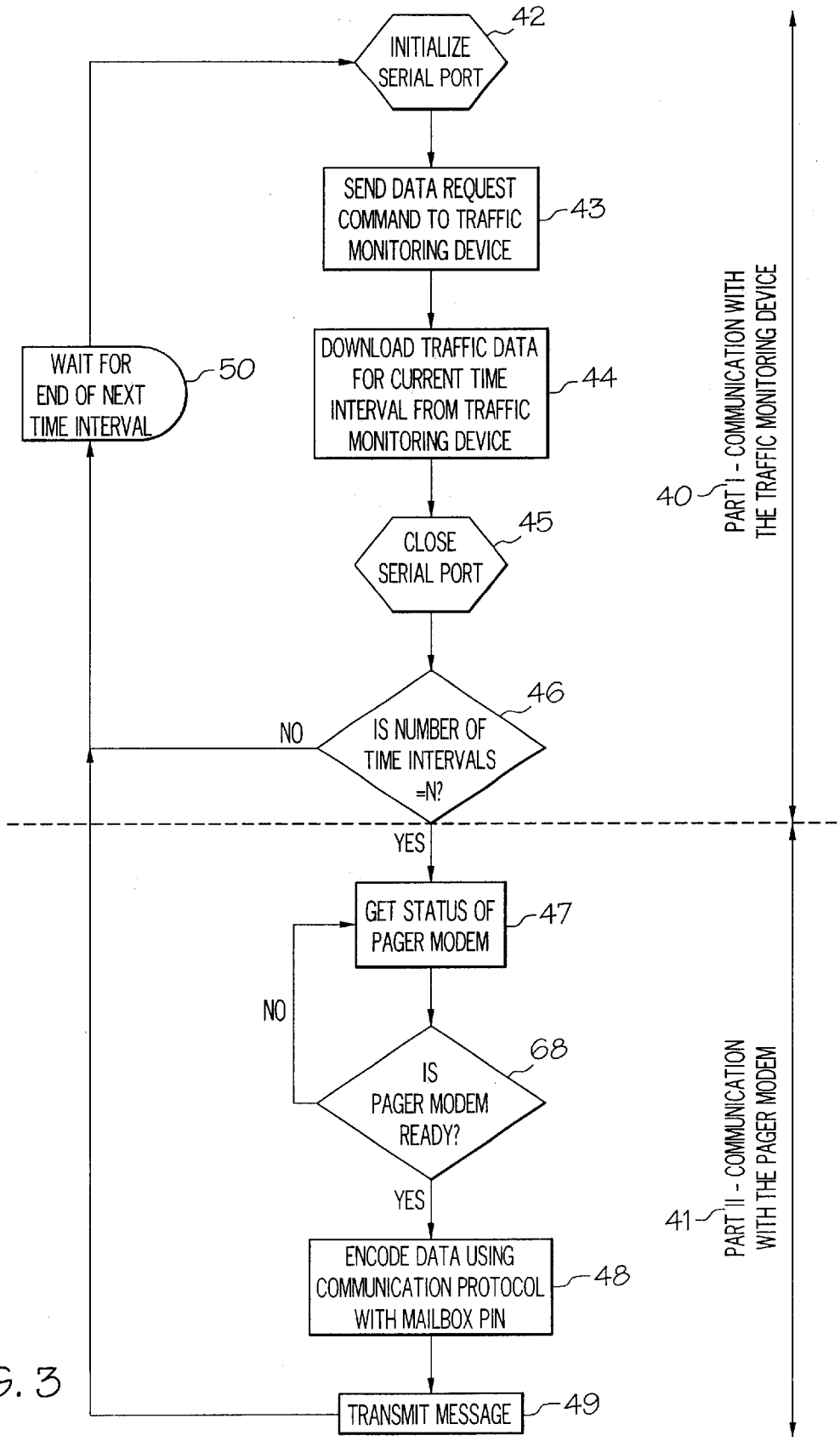
FIG. 3 is a flow diagram of a preferred embodiment of a software program operating on the micro-controller of the communicating device, in accordance with a preferred embodiment of the present invention.

The above-described interfaces and functions of the communicating device 3 are preferably achieved via software resident within the device. FIG. 3 is a flow diagram of an example of software operable on the microcontroller 4. In the preferred embodiment, the software is developed using any commonly available programming languages such as C++, PASCAL, BASIC. After the software program is compiled and assembled or linked into an EXE or a COM executable form, it is uploaded onto the Flash Memory 17 using any standard communication program using the X-MODEM protocol. In alternate embodiments, depending upon the $\mu$C chosen, the programming language that can be used may be restricted and the method of upload of the compiled and linked software onto the $\mu$C may require additional hardware and/or software.

In general, the software consists of two components. The first component 40, controls periodic communication between the $\mu$C 4 and the traffic monitoring device 1. Once the $\mu$C 4 has collected data for a certain period, the software passes control to the second component 41. In the second component 41, the $\mu$C 4 communicates with the pager modem 5 for transmitting the data. Depending on the host processor used, simultaneous communication with both the traffic monitoring device 1 and the pager modem 5 is also possible.

With reference to FIGS. 2 and 3, during a data download from the traffic monitoring device 1, the software first executes an initialization 42 of the serial port Console/COM2 19. The serial port settings may differ between traffic monitoring device types as shown in Table 2.

TABLE 2

| Port Settings for the Traffic Monitoring Devices | | | |
|---|---|---|---|
| Port Setting | 170E Controller | Model 241 | RTMS |
| Baud Rate | 1200 | 9600 | 9600 |
| Number of Bits | 7 | 8 | 8 |
| Parity | Even | Even | None |
| Stop Bits | 1 | 1 | 1 |

Upon initialization of the console/COM2 serial port 19, a data request command is sent 43 to the traffic-monitoring device 1. The communication protocols adopted by the manufacturer for each traffic-monitoring device specify the format of the data request command string. In response to the data request command, the traffic-monitoring device 1 downloads 44 the requested data to the $\mu$C 4. The communication protocols adopted by the manufacturer for each device also specify the format of the output data. Based upon this, the $\mu$C 4 parses the downloaded data stream and extracts the relevant traffic information. Following this, the serial port console/COM2 is closed 45.

The processor waits for the next time interval 50 and the above steps are repeated. The software can be modified to achieve different time periods between each download. Once the data is accumulated for a certain period 46, or for a certain number of iterations, control is transferred to the second component 41 for handling data communication with the pager modem 5 as described below.

A communication protocol for interfacing with the pager modem is preferably configured according to specifications provided for the particular modem used. For the modem specified above, the suitable protocol is provided in the document Communication Linking Protocol, available from Motorola. Alternatively, pre-written software source code incorporating the CLP™ protocol available from Motorola may be used for the modem specified above While operating under the second component 41, the processor determines the status 47 of the pager modem 5, which, at any given time, can be operating in any one of a number of states 68, for example: the pager modem may have temporarily suspended transmission, or may be currently busy transmitting a message, or may be ready to accept the message. If the processor receives a busy signal from the modem, its status is periodically updated, for example once every 2 seconds, until successful or for a maximum of 1 minute. If a ready to transmit signal is not obtained from the modem for time period over a minute, the software aborts after logging the error in an appropriate error-log file.

Assuming the above status check was successful, a message string is constructed 48 comprising the master mailbox identification and the traffic information using, for example the well-known CLP™ protocol, or other data transmission protocols. A transmit message command is next executed 49 to upload the message string to the pager modem 5. Assuming the message has been successfully uploaded, the pager modem 5 transmits an acknowledgement back to the processor 4.

Once the message has been introduced into the paging network, software control is transferred back to the first component where it waits 50 to download data from the traffic-monitoring device 1 for the next time interval.

Referring back to FIG. 1, on the receiving end, the message is received by a central computer server 7. The central computer server 7 is preferably capable of receiving messages transmitted over the two-way paging network 6. Upon receiving a message, the server first processes the destination address encoded into the message string. If the destination address is the number of a master mailbox, the server decodes the data portion of the message string and stores it in the appropriate master mailbox 8. Periodically, the server executes an autocopy function 9 in which each mailbox number is inspected within a database to determine if its contents need to be copied to other mailboxes. The database provides the mapping between the master mailbox 9 and the various user mailboxes 10. Thus, contents of the master mailbox 9 are deposited into the individual user mailboxes 10. The central computer server incorporates an Internet socket server with a TCP port to allow users to access the contents of their mailbox over the Internet 11 using standard Transmission Control Protocol/Internet Protocol (TCP/IP).

Referring back to FIG. 1, the central computer server is shown with only one master mailbox 8. This is for illustration only. The central computer may optionally host several master mailboxes, each associated with a distinct group of users. Further, assuming only a single user and data sharing is not relevant to that specific circumstance, then the master mailbox could itself serve as the mailbox of the single user.

An example of the central computer server with the functionality disclosed above is the server located within SkyTel's ReFLEX Telemetry Services' Network Operations Center (NOC). In the preferred embodiment, the central computer server performs two major functions: one, to receive message transmitted over the paging network, and the other, to maintain the various master and user mailboxes and allow access to them over the Internet In an alternative embodiment, the two functions may be hosted on two distinct computer servers. The function of receiving two-way paging messages could be performed by the server within SkyTel's NOC, while the rest could be hosted by a separate computer server. This second server would periodically query the SkyTel NOC server to download all messages transmitted over the paging network, and then perform all the processing of the messages to deposit into the appropriate master and/or user mailboxes.

Preferably associated with the previously described method and communicating device is a user software package installed at a user's workstation 13 programmed to download the data from the central computer server mailbox 10 via the Internet 11. Alternatively, a general purpose Internet browser may be used to download the data. In this case, the central computer server would require installation of software in order to be able to respond to data requests from the Internet browser.

Figure 4:
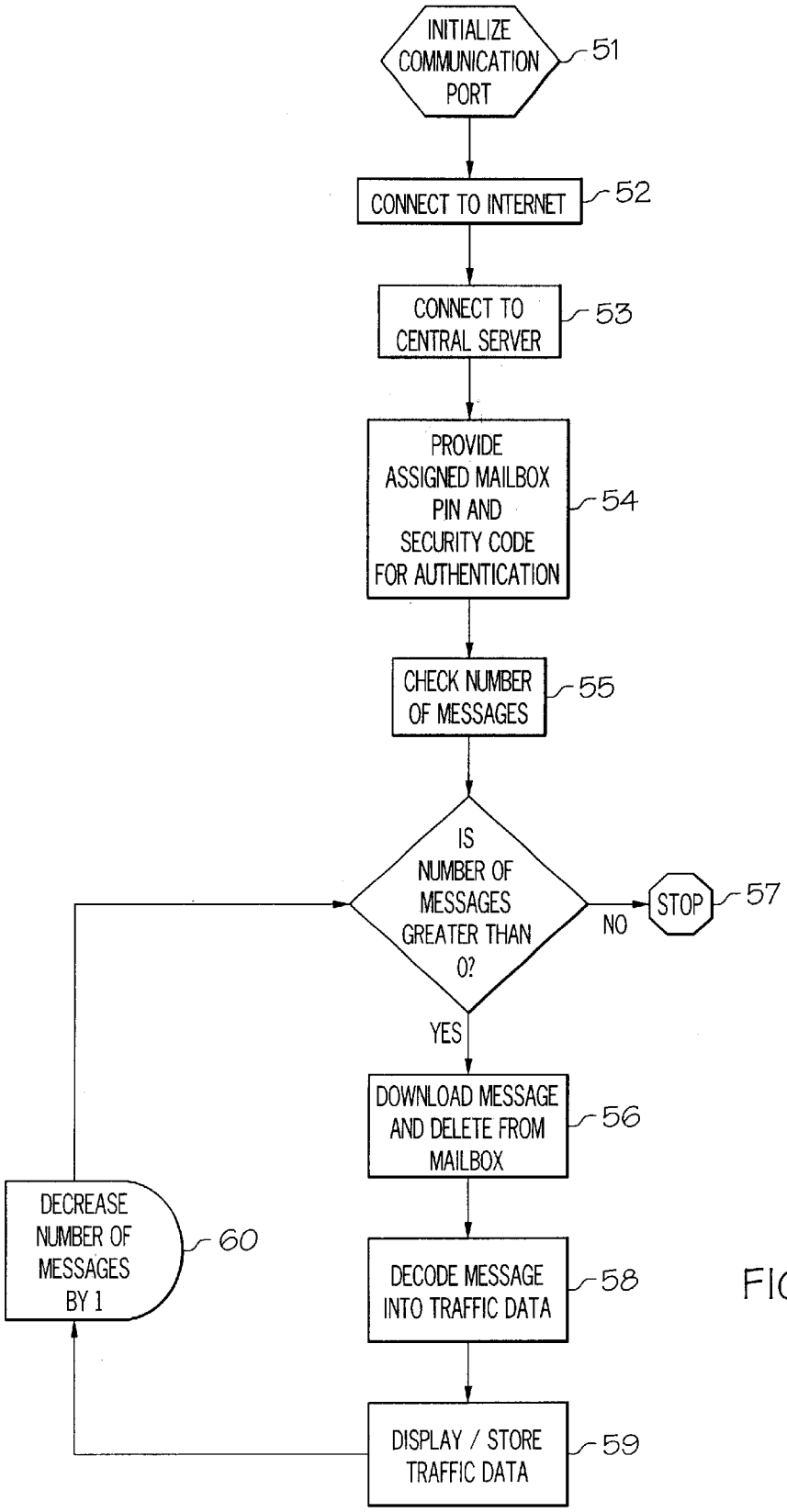
FIG. 4 is a flow diagram of a preferred embodiment of a software program operating on the user's workstation, for allowing a user to download traffic data from the central computer server over the Internet, in accordance with the present invention.

With reference to FIG. 4 and FIG. 1, the user software initializes the communication port 51 on the workstations 13 and then connects 52 to the Internet 11 for example using a dial-up modem or a network interface card. If a dial-up modem is used, connection to the Internet may be achieved by using any standard Internet Service Provider (ISP). Alternatively, connection to the Internet may be through a proxy server on a Local Area Network (LAN) communicating with the workstation with the help of a network interface card. In the latter case, any existing "firewall" or security software may need to be configured by the LAN system administrator to allow the user software on the workstation 13 to access the central computer server 7. Upon connecting to the Internet, the user software then contacts 53 the central computer server 7 using standard Transmission Control Protocol/Internet Protocol (TCP/IP).

Upon connecting to the central computer server 7, the user software provides 54 the computer server 7 with the user mailbox 10 personal identification number (PIN) and security code, in order to establish that authenticity of the user. Once authenticity is verified, the user software next determines 55 the number of messages in the user's mailbox 10. If the number of messages is greater than zero, the messages are downloaded 56. If not, the software exits the program 57.

Once the data is downloaded from the user mailbox 10, the user software decodes 58 the binary data, the decoding procedure essentially comprising the reverse of the encoding procedure 48 employed by the $\mu$C 4. The data can then be either displayed 59 on a map or simply stored for later processing.

The user software downloads all messages in the user mailbox, decreasing the number of messages by one 60, until the number of messages in the user mailbox reaches zero. At this point, the software exits the program 57.

The traffic monitoring system and method disclosed above are achieved over the two-way paging network, which provides the ability to send data from remote devices to a central computer server. Even though, in a preferred embodiment, only the so-called "reverse" channel is utilized in the present invention, a one-way paging network would be insufficient. In a one-way paging network only the "forward" channel is provided where data can be sent from a central computer server to remote devices and not in the reverse manner. An example of a two-way paging service is SkyTel's ReFLEX Telemetry Services In this manner, a traffic monitoring system and method are provided that allow for remote monitoring of traffic sites by a plurality of users. A plurality of traffic monitoring devices record data related to traffic events. The data is encoded and communicated to a central server using wireless paging technology. The central server decodes and distributes the communicated data, and makes the data available to a plurality of remote users. The remote users access the data, for example via the Internet, in order to remotely evaluate the traffic situation.

While this invention has been particularly shown and described with references to preferred embodiments thereof, it will be understood by those skilled in the art that various changes in form and details may be made therein without departing from the spirit and scope of the invention as defined by the following claims.

I claim:

1. A method of communicating vehicular-traffic-related data from a vehicular traffic monitoring device to a user comprising:

extracting vehicular-traffic-related data from a vehicular-traffic monitoring device;

encoding the collected vehicular-traffic-related data according to wireless paging protocol;

transmitting the encoded vehicular-traffic-related data over a wireless paging network to a server; and receiving the transmitted encoded vehicular-traffic-related data at the server, to enable user access to the vehicular-traffic-related data via the server.

2. The method of claim 1 wherein extracting vehicular-traffic-related data from the vehicular-traffic monitoring device comprises periodically polling the vehicular-traffic monitoring device for updated vehicular-traffic-related data.

3. The method of claim 1 wherein encoding the collected vehicular-traffic-related data comprises:

encoding the vehicular-traffic-related data according to wireless paging protocol to enable vehicular-traffic-related data transmission in binary format to the server.

4. The method of claim 3 further comprising:

polling the wireless paging network to determine transmission availability; and when available, transmitting the encoded vehicular-traffic-related data over the wireless paging network to the server.

5. The method of claim 1 wherein the decoded vehicular-traffic-related data received at the server is stored in a master mailbox and further comprising duplicating the stored vehicular-traffic-related data from the master mailbox to a user mailbox.

6. The method of claim 5 further comprising downloading the vehicular-traffic-related data in the user mailbox remotely from a PC workstation via the Internet.

7. The method of claim 6 wherein downloading further comprises:

establishing authenticity of the user;

downloading the vehicular- traffic-related data from the user mailbox to the PC workstation; and interpreting and storing the vehicular-traffic-related data at the PC workstation.

8. The method of claim 1 wherein the server duplicates the received vehicular-traffic-related data to enable access to the vehicular traffic-related data by multiple users.

9. The method of claim 1 further comprising downloading the received and decoded vehicular-traffic-related data by a user via the Internet.

10. The method of claim 1 wherein the vehicular-traffic-related data includes volume, occupancy and speed.

11. A system for communicating vehicular-traffic-related data from a vehicular-traffic monitoring device to a user comprising:

a traffic monitoring device for collecting vehicular-traffic-related data;

a communication device for extracting vehicular-traffic-related data from the traffic monitoring device and encoding the extracted vehicular-traffic-related data according to a wireless paging protocol;

a pager modem for transmitting the encoded vehicular-traffic-related data over a wireless paging network; and a server for receiving the transmitted encoded data to enable user access to the vehicular-traffic-related data via the server.

12. The system of claim 11 wherein the communication device periodically polls the traffic monitoring device for updated vehicular-traffic-related data and wherein the communicating device further comprises:

a processor having first and second data ports for respectively interfacing with the traffic monitoring device and the pager modem;

memory for hosting embedded software including traffic monitoring device interface protocol and wireless paging protocol, and for storing data.

13. The system of claim 12 wherein the communication device further periodically requests vehicular-traffic-related data from the traffic monitoring device, receives the requested vehicular-traffic-related data, encodes the vehicular-traffic-related data according to wireless paging protocol to enable vehicular-traffic-related data transmission in binary format to the server; and stores the encoded data in the memory.

14. The system of claim 12 wherein the communication device further periodically polls the pager modem to determine transmission availability; and when available, uploads the vehicular-traffic-related data to the pager modem to transmit the encoded vehicular-traffic-related data over the wireless paging network.

15. The system of claim 11 wherein the server stores the decoded vehicular-traffic-related data in a master mailbox and further comprising means for duplicating the stored vehicular-traffic-related data from the master mailbox to a user mailbox to enable multiple user access.

16. The system of claim 11 wherein the server provides for remote access to the user mailbox via the Internet.

17. The system of claim 16 further comprising a PC workstation coupled to the Internet to allow for remote access of user mailbox data over the Internet, the PC workstation including software enabling a user to:

establish user authenticity with the server;

download the vehicular- traffic-related data from the user mailbox to the PC workstation; and interpret and store the vehicular-traffic-related data at the PC workstation.

18. The system of claim 11 wherein the server duplicates the received vehicular-traffic-related data to enable access to the vehicular traffic-related data by multiple users.

19. The system of claim 11 further comprising a remote PC workstation for downloading the received and decoded vehicular-traffic-related data by a user via the Internet.

20. The system of claim 11 wherein the vehicular-traffic-related data includes volume, occupancy and speed.

* * * * *